US006467993B1

(12) United States Patent
Utter et al.

(10) Patent No.: US 6,467,993 B1
(45) Date of Patent: Oct. 22, 2002

(54) FISH ATTRACTIVE DEVICE

(76) Inventors: Philip A. Utter, 117 Sherwood Forest Dr., Petal, MS (US) 39465; John Bystricky, 11 Cannonade Blvd., Mobile, AL (US) 36527

( * ) Notice: Subject to any disclaimer, the term of this patent is extended or adjusted under 35 U.S.C. 154(b) by 0 days.

(21) Appl. No.: 09/851,990

(22) Filed: May 10, 2001

Related U.S. Application Data

(60) Provisional application No. 60/202,535, filed on May 10, 2000.

(51) Int. Cl.[7] ..... E02B 3/00
(52) U.S. Cl. ..... 405/24; 405/26; 119/221
(58) Field of Search ..... 405/24, 21, 23, 405/26, 28, 63; 43/4, 4.5; 119/217, 221, 253, 254, 256, 207, 215

(56) References Cited

U.S. PATENT DOCUMENTS 4,086,161 A * 4/1978 Burton ..... 210/13
4,130,994 A * 12/1978 Van Moss, Jr. ..... 405/24
4,203,935 A 5/1980 Hackenjos
4,465,399 A * 8/1984 Kikuzawa et al. ..... 405/32
4,872,782 A * 10/1989 Streichenberger ..... 405/24
5,370,476 A * 12/1994 Streichenberger ..... 405/25
5,454,665 A 10/1995 Hughes
5,564,369 A * 10/1996 Barber et al. ..... 119/221
5,807,023 A * 9/1998 Krenzler ..... 405/21
5,836,265 A * 11/1998 Barber et al. ..... 119/221
5,884,585 A * 3/1999 Streichenberger ..... 119/221
6,056,476 A * 5/2000 Streichenberger ..... 405/24
6,186,702 B1 2/2001 Bartkowski

* cited by examiner

*Primary Examiner*—Thomas B. Will
*Assistant Examiner*—Raymond W Addie
(74) *Attorney, Agent, or Firm*—Jagtiani+Guttag

(57) ABSTRACT

An artificial reef comprising a string of open bodies, a floatation device and an anchoring device.

28 Claims, 11 Drawing Sheets

FISH ATTRACTIVE DEVICE

CROSS-REFERENCE TO RELATED APPLICATIONS

This application makes reference to the following co-pending U.S. Patent Application: U.S. Provisional Patent Applicant No. 60/202,535, entitled "Fish Attraction Device," filed May 10, 2000, the entire contents and disclosure of which is hereby incorporated by reference.

BACKGROUND OF THE INVENTION

1. Field of the Invention The present invention relates generally to artificial reefs, and more particularly to a type of structure suitable for making an artificial fishing reef.

2. Description of the Prior Art

The natural bottom of the sea floor in several offshore areas in the United States is flat and sandy. Unfortunately, a flat and sandy bottom type sea floor attracts few fish that are either commercially or recreationally valuable. However, it has long been known that if vertical reef is created on this bottom that many reef fish such as snappers and groupers will be attracted. Offshore artificial reefs have long been used to attract marine fish and other marine animals to a particular area by creating vertical relief. Offshore artificial reefs can be created that over time will appear as natural reefs with similar communities of encrusting organisms and bait fish. As various encrusting organisms such as corals and sponges cover the artificial reef material, small animals take up residence. As these small animals become abundant larger animals are attracted and feed upon these. Yet larger fish are attracted to these and so on until a complete reef food web is created. At that point the artificial reef functions as a natural reef.

Usually, offshore artificial reefs are built within seventy to hundred feet of the surface of the body of water. The increase in productivity and proximity to the surface provides more accessible fishing grounds for commercial fisheries, more accessible fishing grounds for sports anglers, and provides scuba divers a new nature observation post photographing marine life. Similarly, inshore artificial reefs provide the same benefits as offshore artificial reefs.

Currently, most artificial reefs are made out of rock, concrete or steel, usually in the form of surplus or scrap materials. However, many types of materials, such as: automobiles, parts of automobiles, whiteware appliances, shopping carts, PVC pipes, etc. are prohibited from being used in artificial reefs by the federal and or the state governments and individuals interested in building an offshore artificial reef must contact a government agency to receive a permit to build in a particular area. The configurations of artificial reefs must be such as to not danger the individuals who may use the artificial reefs once deployed. Additionally, when deployed in salt water, the artificial reef must resist the effects of salt water for a long time.

Individuals interested in building an artificial reef must also generally follow the deployment procedures issued by federal or state agency by filing a float plan. Since concrete and steel are commonly used in artificial reefs, deployment of an artificial reef usually requires a tug boat pushing a large barge with an crane to lower the artificial reef to the ocean bottom. Some materials once deployed require an anchoring device to prevent disassociation of the material from the area where the artificial reef may be deployed.

The typical approach of using concrete and steel structures for artificial reefs suffers from several limitations. For, example, the concrete and steel structures for artificial reefs cannot provide large surface areas for attracting small ocean life. Therefore, the artificial reef does not mimic the natural reef. Also, concrete and steel structures for artificial reefs are costly to deploy and maintain. This cost is an obstacle for individuals seeking to construct small private reefs.

SUMMARY OF THE INVENTION

It is therefore an object of the present invention to provide an artificial reef that ay be easily deployed.

It is another object of the present invention to provide an artificial reef that is relatively low cost.

It is another object of the present invention to provide and artificial reefs that functions similarly to a natural reef.

According to a first broad aspect of the present invention, there is provided an artificial reef comprising: a plurality of open bodies; linking means for arranging the open bodies in at least one string of open bodies; an anchoring means connected to the at least one string of open bodies at a distal end of the string of open bodies, the anchoring means anchoring the artificial reef when the artificial reef is deployed in a body of water; a floatation means attached to a proximal end of the at least one string of open bodies, the floatation means causing the at least one string of open bodies to extend upward when the artificial reef is deployed in a body of water.

According to second broad aspect of the invention, there is provided method of deploying an artificial reef comprising: providing an artificial reef comprising: a plurality of open bodies; linking means for arranging the open bodies in at least one string of open bodies; an anchoring means connected to the at least one string of open bodies at a distal end of the string of open bodies; and a floatation means attached to a proximal end of the at least one string of open bodies, the floatation means causing the at least one string of open bodies to extend upward when the artificial reef is deployed in a body of water; and deploying the artificial reef in a body of water.

Other objects and features of the present invention will be apparent from the following detailed description of the preferred embodiments of the present invention.

BRIEF DESCRIPTION OF THE DRAWINGS

The invention will be described in conjunction with the accompanying drawings, in which.

DETAILED DESCRIPTION OF THE PREFERRED EMBODIMENT

It is advantageous to define several terms before describing the invention. It should be appreciated that the following definitions are used throughout this application.

Definitions

Where the definition of terms departs from the commonly used meaning of the term, applicant intends to utilize the definitions provided below, unless specifically indicated.

For the purposes of the present invention, the term "artificial reef" refers to any man-made structure that is deployed in a body of water to perform one or more of the functions of natural reef, such as: providing reliefs where marine life can establish habitats, providing shelter for pelagic fish and feeding grounds for pelagic fish, preventing erosion on the shore, along the shore, or the water body's floor, etc. Marine life may also grow on an artificial reef once the marine life establishes a habit.

For the purpose of the present invention, the term "proximal" refers to the end(s) of an artificial reef that extends upward when the artificial reef is deployed in a body of water.

For the purpose of the present invention, the term "distal" refers to the end(s) of an artificial reef that extends downward when the artificial reef is deployed in a body of water.

For the purposes of the present invention, the term "open body" refers to an object having openings therein. The openings of the present invention may be slits, spaces, gaps, holes, cracks, cavities, slots, notches, etc., or any combination thereof.

Figure 1:
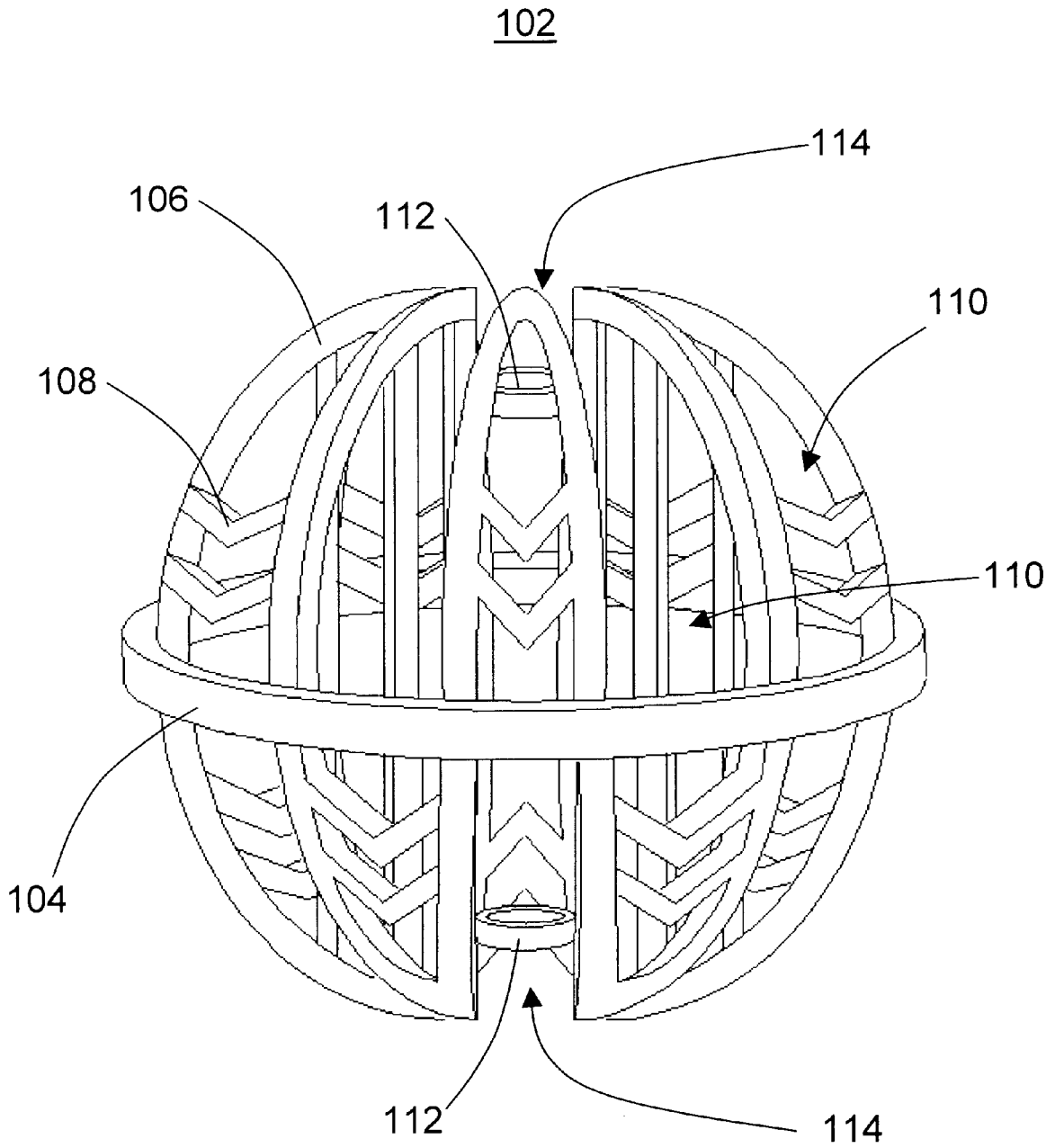
FIG. 1 is a three-dimensional view of an open body, with an internal ribbed network constructed in accordance with a preferred embodiment of the invention.
Figure 9:
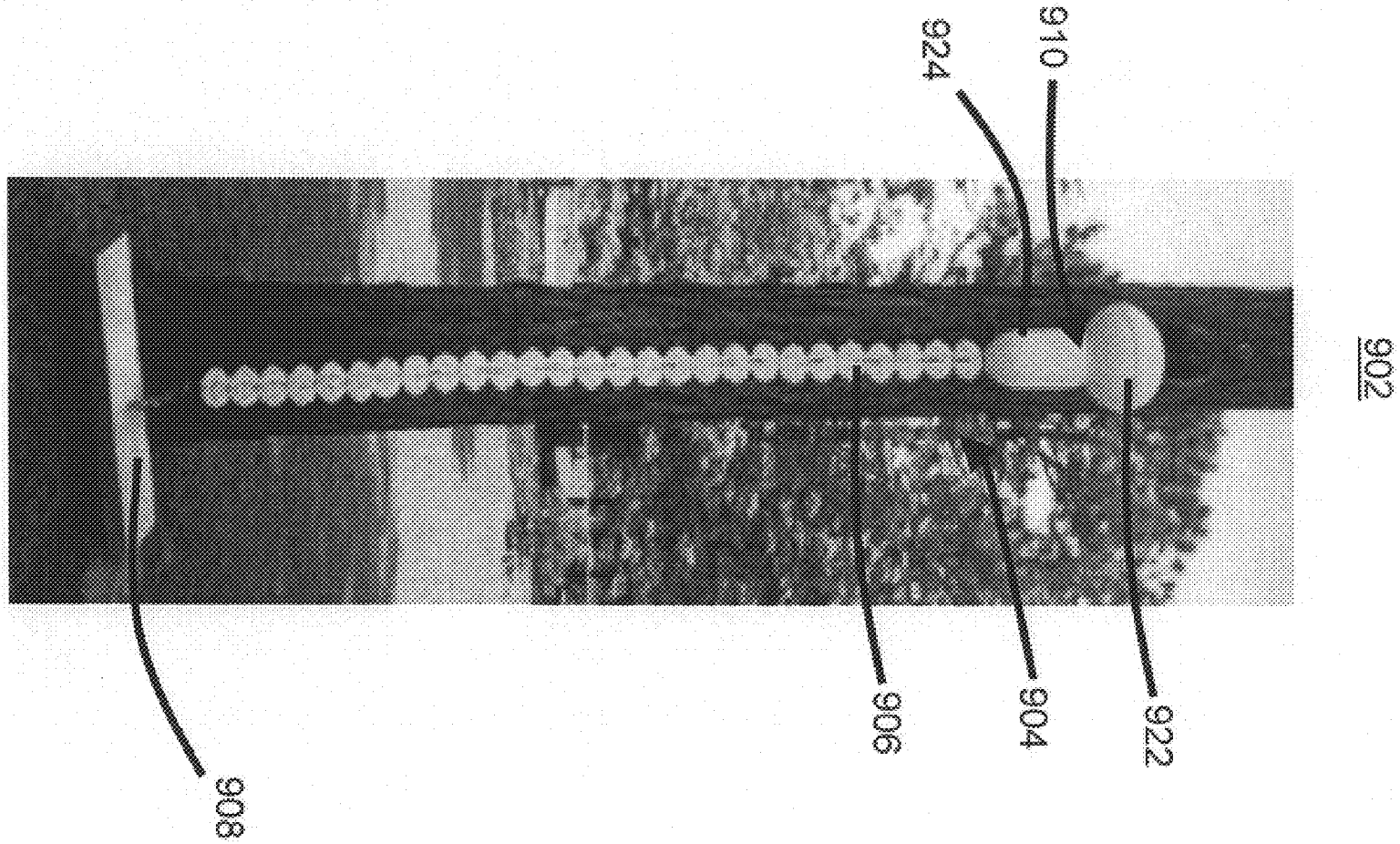
FIG. 9 is a photograph of the artificial reef constructed in accordance with a preferred embodiment of the invention.

For the purposes of the present invention, the term "latticework structure" refers to an open body including struts or ribs on which algae or other marine life may grow. A lattice structure may include regions having struts or ribs or may be entirely formed from struts and ribs. Examples of latticework structures suitable for use in the present invention are shown in FIGS. 1 and 9 below.

For the purposes of the present invention, the term "linking device" refers to one or more device such a cable, a hollow tube, a combination of a hollow tube and cable, a chain, a wire, etc. that links a series of open bodies into a string of open bodies. In a preferred embodiment, a linking device of the present invention may extend through the open bodies of the present invention like beads on a string. In another embodiment, the linking device may consist of a number of cables, hollow tubes, a hollow tube, a combination of a hollow tube and cable, a chain, a wire, etc. each of which link two adjacent open bodies to each other.

For the purposes of the present invention, the term "string" refers to the entire assembly of open bodies attached to a hollow tube. The string is connected to the linking device through the opening in the hollow body. The artificial reef may have more than one string of open bodies, but for each string of hollow bodies there is at least one linking device which connects the string or plurality of strings to at least one anchoring device and at least one floatation device.

For the purposes of the present invention, the term "anchoring device" refers to any structure that has sufficient weight in relation to the amount of strings attached, to keep the entire structure in substantially the same location in a body of water. The anchoring device can be attached to the distal end of the linking device. Although the anchoring device can be attached to the distal end of the linking device, the weight of the anchor device can be at more than two places and can extend upward, downwards, sideways or diagonally from the distal end of the linking device. The anchoring device may comprise concrete, steel, plastic, rubber, etc., or any combination thereof. Usually an anchoring device will anchor an artificial reef of the present invention to the floor of a body of water. The anchoring device may also anchor the present invention to any relief, such as natural reefs, sunken surface vessels, rocks, fallen objects, etc., that is either fully submerged or partial submerged in a body of water.

For the purposes of the present invention, the term "body of water" refers to any body of water, either natural, such as a river, stream, ocean, sea, gulf, lake, pond, etc., or artificial, such as a man-made reservoir, canal, irrigation ditch, aquarium, etc.

For the purposes of the present invention, the term "deployed" refers to the physical act of submerging an artificial reef into a body of water, so that the entire article reef rests within the body of water, and the proximal end of the artificial reef extends up from the surface of the water. The present invention may be deployed using a crane, manpower, winches, pulleys, helicopter, barges, etc.

For the purposes of the present invention, the term "floatation means" refers to any device which has at least one float which is attach to proximal end of the cable.

For the purposes of the present invention, the term "spherical" refers to the shape of an object where the distance from the center of the object to the outermost shell is substantially the same in at least three directions. Spherical shapes can include pyramids, cubes, polygons, sphere, etc. For example, in the present invention the open body substantially resembles a sphere in shape.

For the purposes of the present invention, the term "diameter" refers to distance along any line drawn through the center of an object, such as the open body, a hollow tube, etc.

For the purposes of the present invention, the term "injection moldable resin" refers to any resin that may be molded using conventional injection molding techniques. Examples of injection moldable resin include: polyethylene, polypropylene, polyvinyl chloride, etc.

For the purposes of the present invention, the term "latticework" refers to a tructure of internal ribs within an open body.

For the purposes of the present invention, the term "cable device" refers to any long extended material that may function like a cable such as: a stainless steel cable, a steel chain, a rope, a plastic cable, a plastic chain, etc. The cable device of the present invention is preferably used in conjunction with a hollow tube through which the cable device extends. However, a cable device may be used by itself as the linking device of the present invention. Preferably, a cable device of the present invention has enough flexibility to allow the artificial reef to sway in the currents of the body of water.

For the purposes of the present invention, the term "restraining means" refers to fastener, holder, lock, brace, etc., which prevents the lateral movement of open bodies along a linking device of the present invention.

Figure 5:
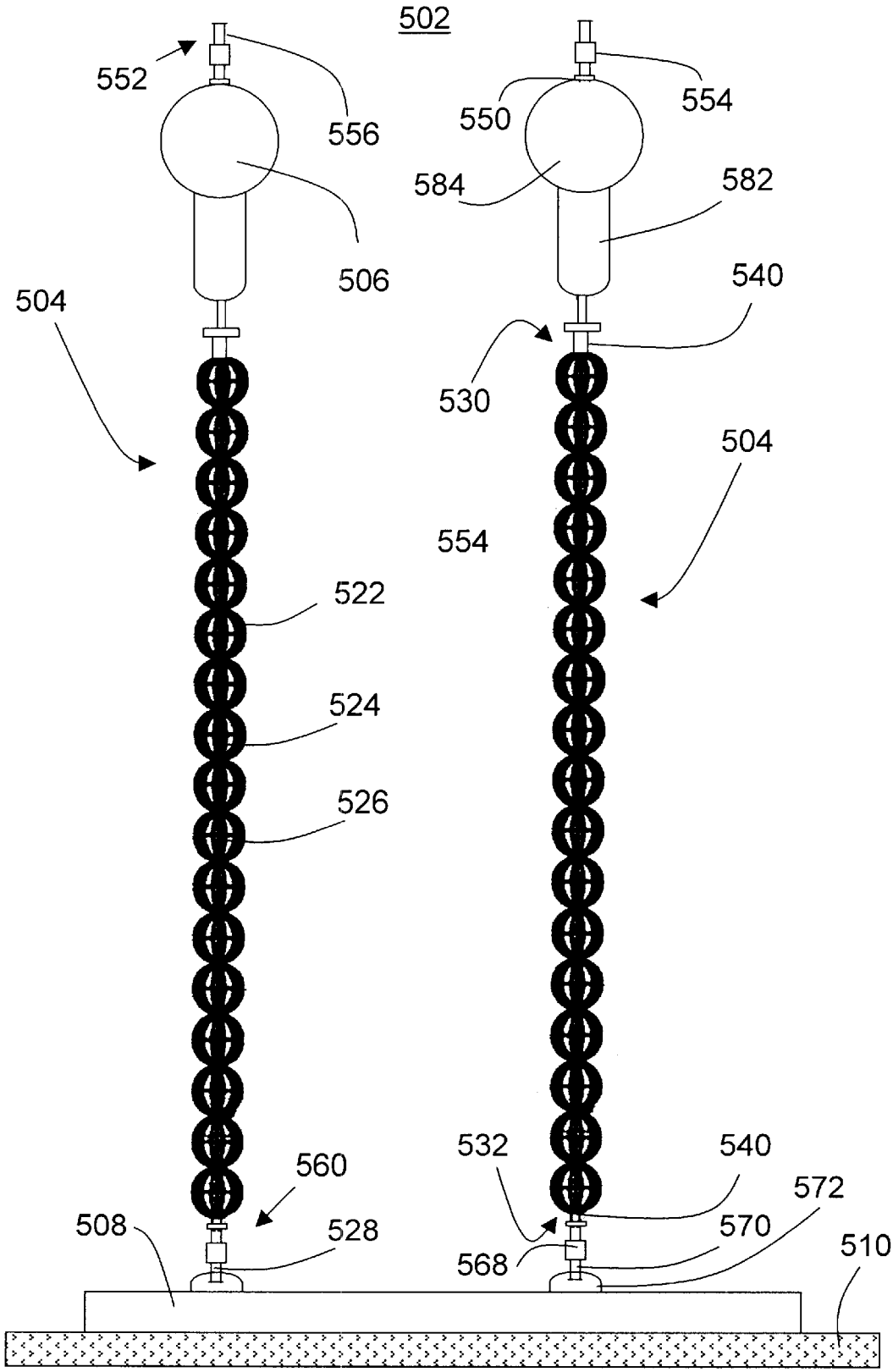
FIG. 5 is a simplified view of an artificial reef constructed in accordance with a preferred embodiment of the invention.
Figure 7:
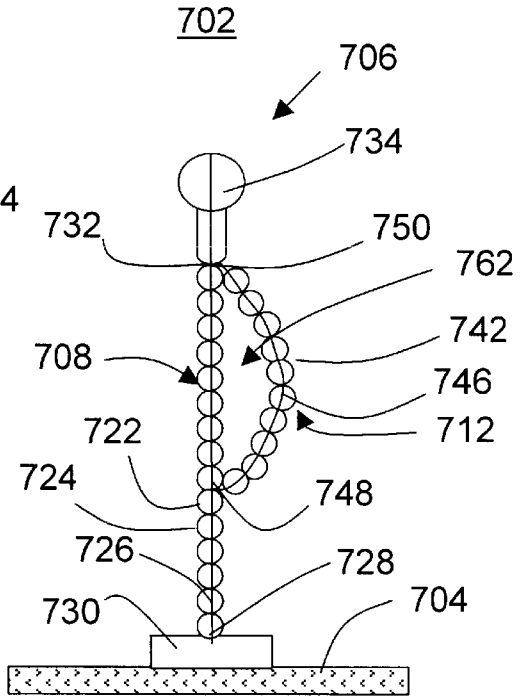
FIG. 7 is a schematic view of the artificial reef with one branch string that shares the same floatation device as the main string constructed in accordance with a preferred embodiment of the invention.
Figure 6:
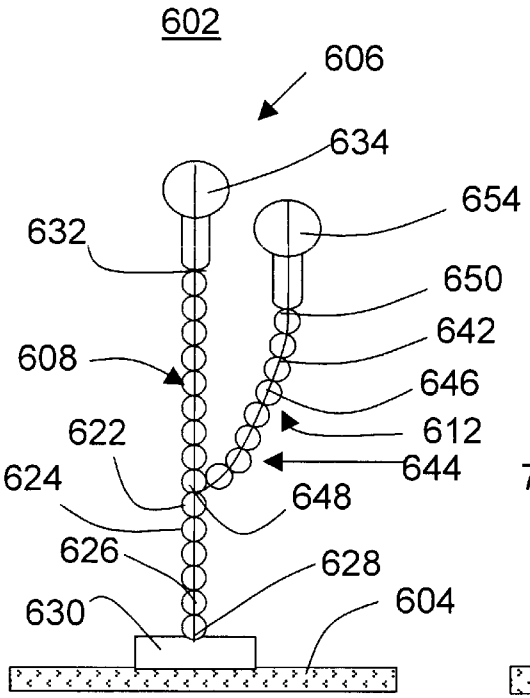
FIG. 6 is a schematic view of the artificial reef with one branch string that has a separate floatation device constructed in accordance with a preferred embodiment of the invention.

For the purposes of the present invention, the term "branched string" refers to a any additional string of hollowed bodies that is attached to a main string of open bodies at some point between the proximal and distal ends of a main string of open bodies. Examples of branched strings are shown in FIGS. 5, 6 and 7.

For the purposes of the present invention, the term "float" refers to any object having buoyancy in fresh water or salt water or combination thereof.

Description

The present invention, provides an artificial reef comprising a plurality of open bodies attached, either fixed or slideable, to a linking means to form at least one string of open bodies which is attached to at the distal end to an anchoring means to anchor said artificial reef and at the proximal end to a floatation means when said artificial reef is deployed in a body of water. This arrangement allows the string of open bodies on the artificial reef to extend upward from the body of water's bottom towards the surface.

FIG. 1 shows an open body 102 of the present invention having an annular meridian ring 104 and a plurality of arcuate bars 106 extending upwardly and downwardly from annular meridian ring 104. Arcuate bars 106 are given lateral bracing by chevrons 108. Open body 102 includes many openings 110 that allow algae (not shown) to grow on open body 102. Two rings 112 and a central opening 114 allow open body 102 to be slid onto and slide on a linking device (not shown in FIG. 1).

Figure 2:
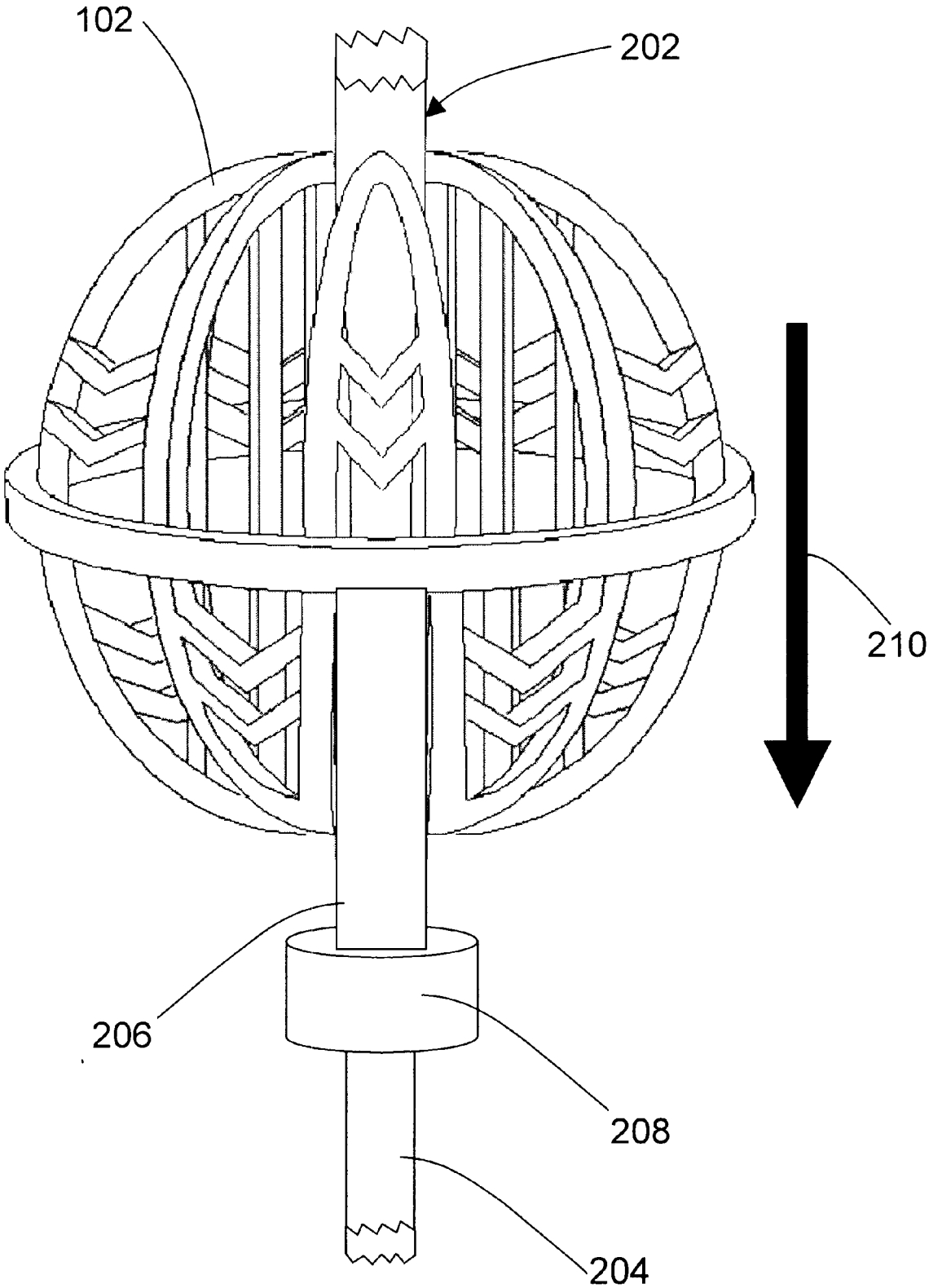
FIG. 2 is a three-dimensional view of an open body attached to a hollow tube constructed in accordance with a preferred embodiment of the invention.
Figure 3A:
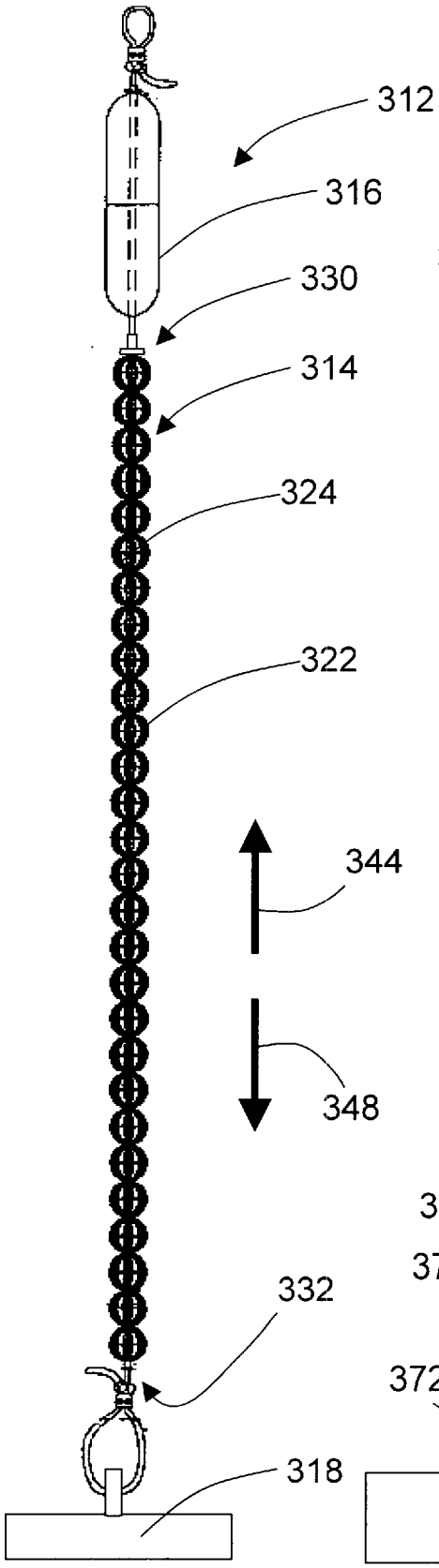
FIG. 3A is side view of an artificial reef in accordance with a preferred embodiment of the invention.
Figure 3B:
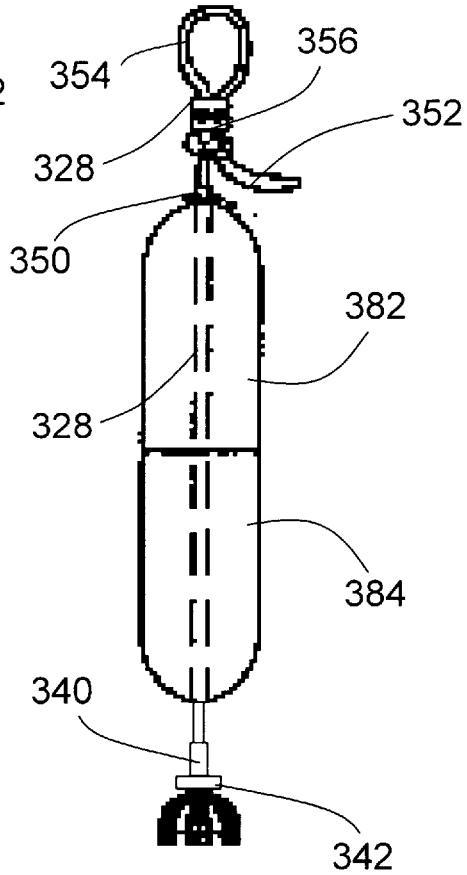
FIG. 3B is an enlarged view of the proximal end of the artificial reef of FIG. 3A.
Figure 3C:
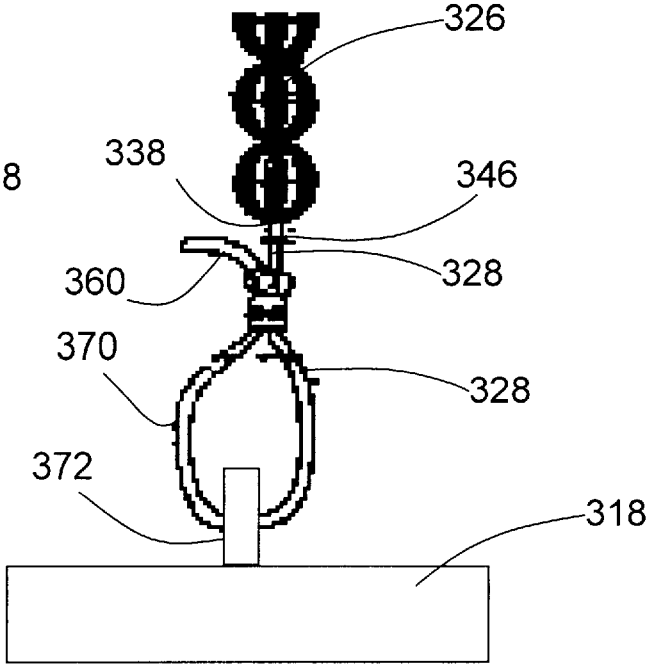
FIG. 3C is an enlarged view of the distal end of the artificial reef of FIG. 3A.
Figure 3D:
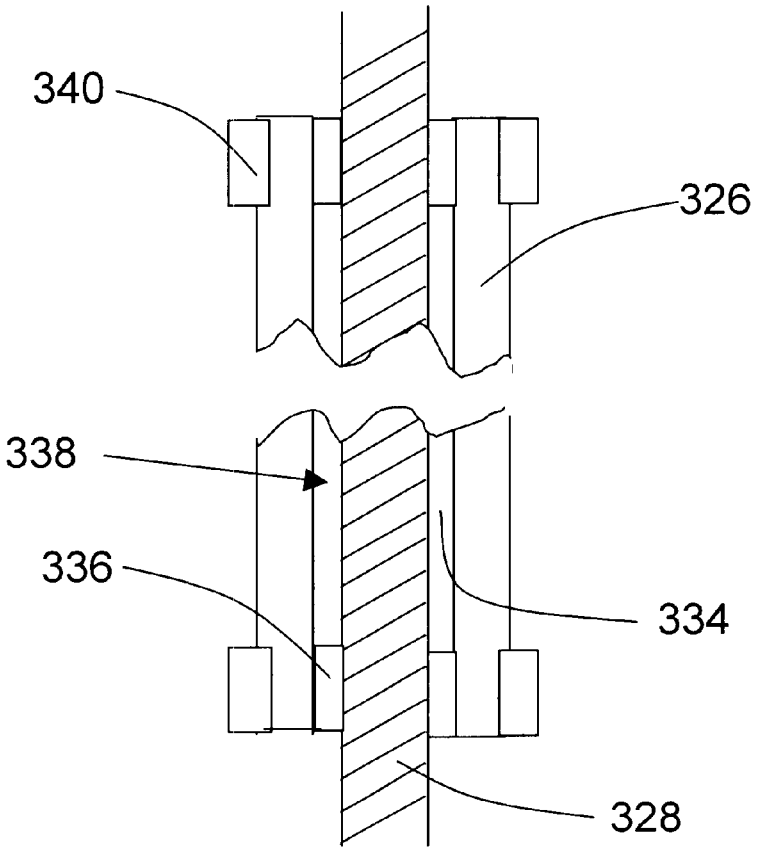
FIG. 3D is a cut-away side view of the linking device used in the artificial reef of FIG. 3A.
Figure 3E:
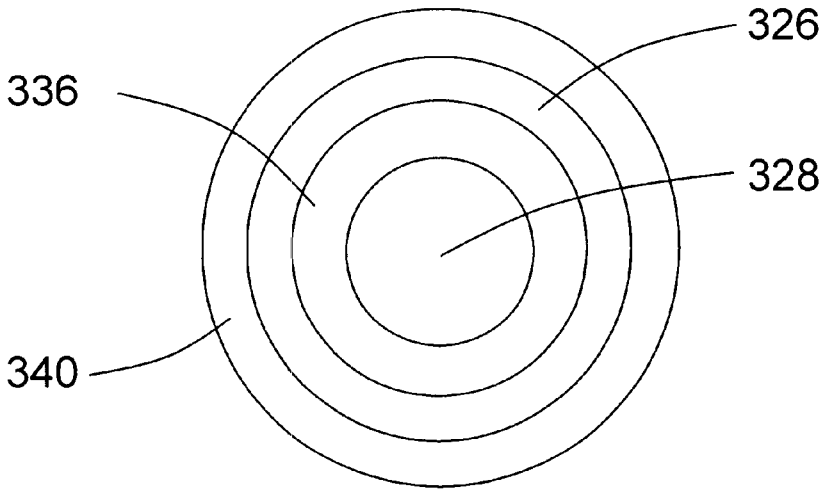
FIG. 3E is cross-sectional view of an end of a hollow tube of the artificial reef of FIG. 3A sealed with an O-ring insert and a compression clamp.

FIG. 2 shows open body 102 of FIG. 1 slid onto a linking device 202, only a 3, zportion of which is shown in FIG. 2. Linking device 202 includes a cable 204 that extends through a hollow tube 206. Mounted on cable 204 is a restraining washer 208 that acts to restrain the movement of open body 102 in one direction shown by arrow 210.

When the cable device of the present invention consists of only a cable, wire, chain, etc., the restraining device, such as the restraining washer shown in FIG. 2, of the present invention may be mounted directly on the cable. However, when the cable device of the present invention consists of a cable extending through a hollow tube, similar to the arrangement shown in FIG. 2, the restraining device may either be mounted on the hollow tube, as shown in FIG. 2 or mounted on the cable. Preferably, the restraining device is mounted on the hollow tube to prevent wear and tear from the open bodies rubbing against the cable.

FIGS. 3A, 3B, 3C, 3D, and 3E show an artificial reef 312 of the present invention including a string 314, a floatation device 316 and an anchoring device 318. String 314 includes open bodies 322 through which a linking device 324 extends. Linking device 324 includes a hollow tube 326 and a cable 328 that extends through hollow tube 326 and extends out of a proximal end 330 and a distal end 332 of hollow tube 326. Because cable 328 is smaller in diameter than hollow tube 326, there is space 334 surrounding cable 328 within hollow tube 326. O-ring inserts 336 are inserted in proximal end 330 and distal end 332 to block off proximal end 330 and distal end 332, respectively, to thereby form an enclosure 338 in hollow tube 326. To maintain O-ring insert 336 in place, a compression clamp 340 is used to crimp hollow tube 326 and 05 ring insert 336 to cable 328. A proximal restraining washer 342 mounted on cable 328 restrains the motion of open bodies 322 in a proximal direction shown by arrow 344 and a distal restraining washer 346 restrains the motion of open bodies 322 in a distal direction shown by arrow 348. Floatation device 316 is mounted on cable 328 of linking device 324. Floatation device 316 is held in place on linking device 324 by a restraining washer 350 mounted on cable 328. A proximal end 352 of cable 328 is tied off and clamped to form a loop 354 by a compression clamp 356. When artificial reef 312 is retrieved from a body of water by a cable having a hook (not shown), the hook is preferably hooked to loop 354. A distal end of 360 of cable 328 is tied off and clamped to form a loop 370 by a compression clamp 368. Loop 370 is looped over a U-bolt 372 to connect string 324 to anchoring device 328. Floatation device 316 includes of two bullet torpedo floats 382 and 384 arranged back to back.

Figure 4A:
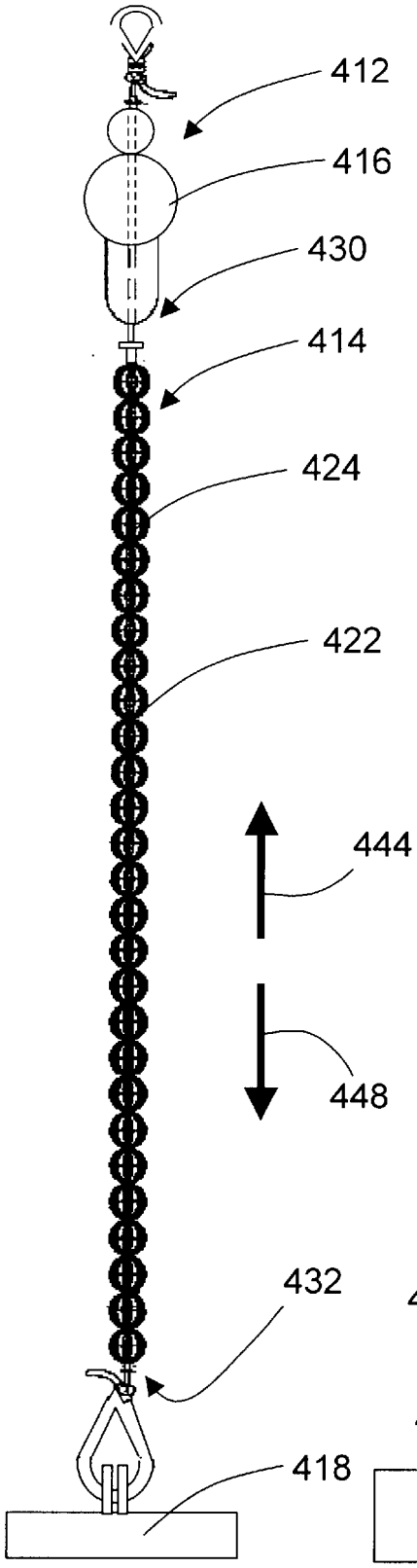
FIG. 4A is side view an artificial reef in accordance with a preferred embodiment of the invention.
Figure 4B:
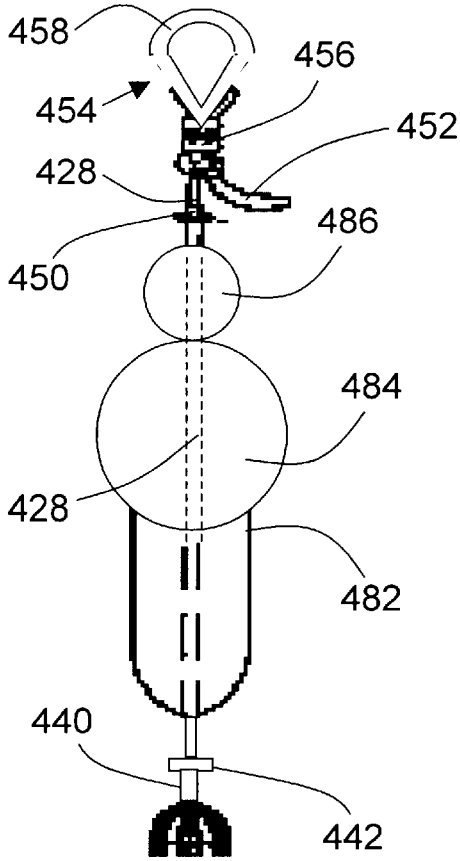
FIG. 4B is an enlarged view of the proximal end of the artificial reef of FIG. 4A.
Figure 4C:
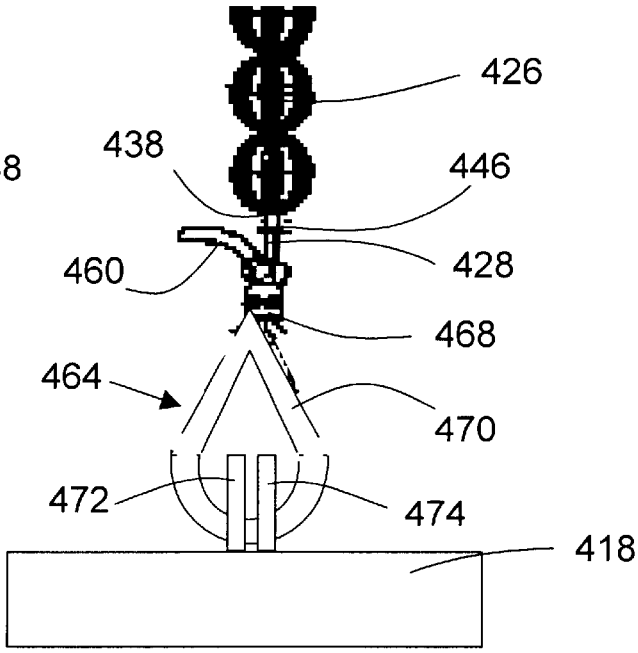
FIG. 4C is an enlarged view of the distal end of the artificial reef of FIG. 4A.

FIGS. 4A, 4B and 4C show another artificial reef 412 of the present invention including a string 414, a floatation device 416 and an anchoring device 418. String 414 20 includes open bodies 422 through which a linking device 424 extends. Linking device 424 includes a hollow tube 426 and a cable 428 that extends through hollow tube 426 and extends out of a proximal end 430 and a distal end 432 of hollow tube 426.

Because cable 428 is smaller in diameter than hollow tube 426, there is space (not shown) surrounding cable 428 within hollow tube 426. O-ring inserts (not shown) are 25 inserted in proximal end 430 and distal end 432 to block off proximal end 430 and distal end 432, respectively, to thereby form an enclosure (not shown) in hollow tube 426. To maintain the O-ring inserts in place, a compression clamp 440 is used to crimp hollow tube 426 and each O-ring insert to cable 428. Floatation device 416 is mounted on cable 428 of linking device 424. A proximal restraining washer 442 mounted on cable 428 30 restrains the motion of open bodies 422 in a proximal direction shown by arrow 444 and a distal restraining washer 448 restrains the motion of open bodies 422 in a distal direction shown by arrow 448. Floatation device 416 is held in place on linking device 424 by a restraining washer 450 mounted on cable 428. A proximal end 452 of cable 428 is tied off and clamped to form a loop 454 by a compression clamp 456. A thimble 458 encloses loop 454 to protect and strengthen loop 454. When artificial reef 412 is retrieved from a body of water by a cable having a hook (not shown), the hook preferably is hooked to thimble 458. A distal end of 460 of cable 428 is tied off and clamped to form a loop 464 by a compression clamp 468. A thimble 470 encloses loop 464 to protect and strengthen loop 464. Thimble 470 is looped over a U-bolts 472 and 474 to connect string 424 to anchoring device 418. Floatation device 416 is comprised of bullet torpedo float 482, a hollow ball float 484 and a utility float 486. Bullet torpedo float 482 serves the function of providing significant buoyancy to floatation device 416. Hollow float 484 serves the function of providing buoyancy to floatation device 416 and making artificial reef 412 easy to locate using sonar. Utility float 486 is generally made of more rugged construction than torpedo float 482 and hollow ball float 486 to provide some floatation to artificial reef 412 even if torpedo float 482 and hollow ball float 486 are damaged. Ball float 484 is joined to bullet torpedo float 486.

FIG. 5 shows an embodiment of an artificial reef 502 of the present invention including two strings 504. Each string 504 is connected to a floatation device 506 and a single anchoring device 508. Anchoring device 508 rests on a sea floor 510. Each string 504 includes open bodies 522 through which a linking device 524 extends. Linking device 524 includes a hollow tube 526 and a cable 528 that extends through hollow tube 526 and extends out of a proximal end 530 and a distal end 532 of hollow tube 526. 0ring inserts (not shown) are inserted in proximal end 530 and distal end 532 to block off proximal end 530 and distal end 532, respectively, to thereby form an enclosure (not shown) in hollow tube 526. To maintain the O-ring inserts in place, a hollow tube clamp 540 is used to crimp hollow tube 526 and each O-ring insert to cable 528. Floatation device 506 is mounted on linking device 524 at proximal end 530 of hollow tube 526. Floatation device 506 is held in place on linking device 524 by a restraining washer 550 mounted on cable 528. A proximal end 552 of cable 528 is tied off and clamped by a compression clamp 554 to form a loop enclosed in a thimble 556. When artificial reef 502 is retrieved from a body of water by a hook (not shown), the hook preferably hooks thimble 556. A distal end of 560 of cable 528 is tied off and clamped by a compression clamp 568 to form a loop enclosed in a thimble 570. Thimble 570 is looped over a U-bolt 572 to connect string 524 to anchoring device 508. Thimble 570 strengthens cable 528 and prevents wear between cable 528 and U-bolt 572. Floatation device 506 is comprised of bullet torpedo float 582 and a hollow ball float 584 attached to torpedo float 582. Bullet torpedo float 582 serves the function of providing significant buoyancy to floatation device 506. Hollow float 584 serves the function of providing buoyancy to floatation device 506 and making artificial reef 502 easy to locate using sonar.

FIG. 6 shows a schematic view of a branched artificial reef 602 of a preferred embodiment of the present invention deployed on a floor 604 of a body of water 606. Branched artificial reef 602 has a main branch 608 and a secondary branch 612. Main branch 608 includes a main string 622 of open bodies 624 through which a main linking 626 device extends. A distal end 628 of main linking device 626 is attached to an anchoring device 630. A proximal end 632 of main linking device 626 is attached to a main floatation device 634. Secondary branch 612 includes a secondary string 642 of open bodies 624 through which a secondary linking device 646 extends. A distal end 648 of secondary linking device 646 is attached to main linking device 626. A proximal end 650 of secondary linking device 646 is attached to a secondary floatation device 654.

FIG. 7 shows a schematic view of a branched artificial reef 702 of a preferred embodiment of the present invention deployed on a floor 704 of a body of water 706. Branched artificial reef 702 has a main branch 708 and a secondary branch 712. Main branch 708 includes a main string 722 of open bodies 724 through which a main linking 726 device extends. A distal end 728 of main linking device 726 is attached to an anchoring device 730. A proximal end 732 of main linking device 726 is attached to a main floatation device 734. Secondary branch 712 includes a secondary string 742 of open bodies 744 through which a secondary linking device 746 extends. A distal end 748 and a proximal end 750 of secondary linking device 746 are attached to main linking device 726 to thereby form a loop 762.

Figure 8:
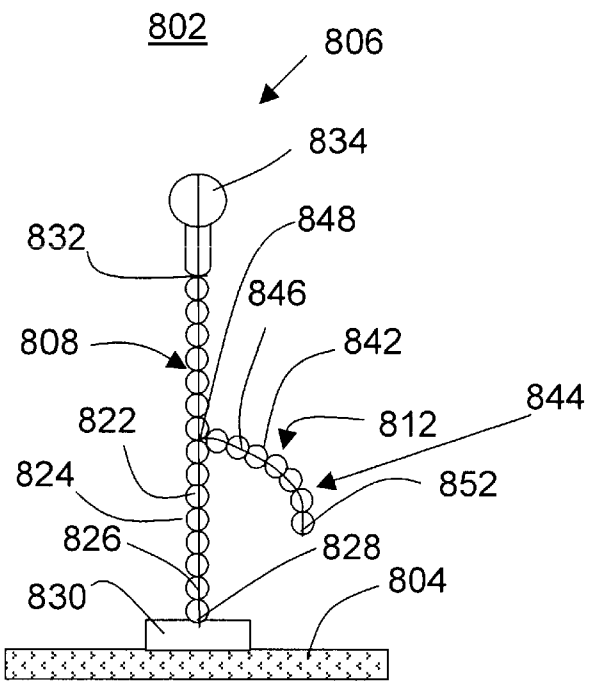
FIG. 8 is a schematic view of the artificial reef with one branch string that has no floatation device constructed in accordance with a preferred embodiment of the invention.

FIG. 8 shows a schematic view of a branched artificial reef 802 of a preferred embodiment of the present invention deployed on a floor 804 of a body of water 806. Branched artificial reef 802 has a main branch 808 and a secondary branch 812. Main branch 808 includes a main string 822 of open bodies 824 through which a main linking 826 device extends. A distal end 828 of main linking device 826 is attached to an anchoring device 830. A proximal end 832 of main linking device 826 is attached to a main floatation device 834. Secondary branch 812 includes a secondary string 842 of open bodies 844 through which a secondary linking device 846 extends. An attached end 848 of secondary linking device 846 is attached to main linking device 826. A free end 852 of secondary branch 812 extends.

In the artificial reef of the type shown in FIG. 8, a weight may be attached to the secondary branch to insure that the secondary branch extends downward.

Although only a few types of artificial reefs with secondary branches are shown in FIGS. 6, 7 and 8, various combinations and types of secondary branches may be used in the artificial reefs of the present invention. Also, an artificial reef of the present invention may include more than one secondary branch.

FIG. 9 is a photograph of an artificial reef 902 of the present invention including a string 904 of plastic latticework, open bodies 906, a concrete anchor 908, and a floatation device 910. Plastic latticework open bodies 906 are 3.5" Jaeger Tri-Packs®. Floatation device 910 is made up of a hollow ball float 922 and a torpedo float 924 that have been adhered together using an adhesive.

Figure 10:
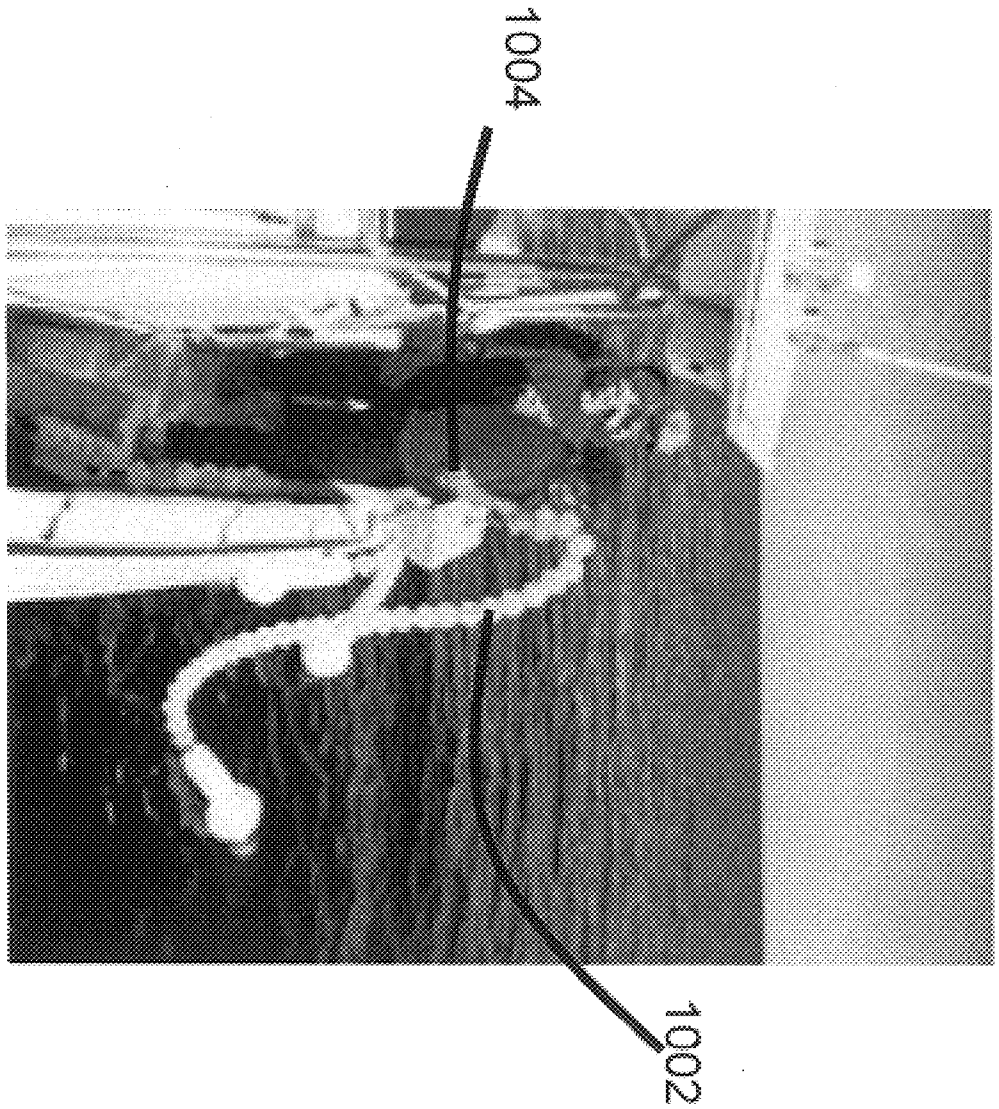
FIG. 10 is a photograph of the deployment of an artificial reef in accordance with a preferred embodiment of the invention.

FIG. 10 is a photograph illustrating the deployment of an artificial reef 1002 of the present invention by individuals 1004.

Figure 11:
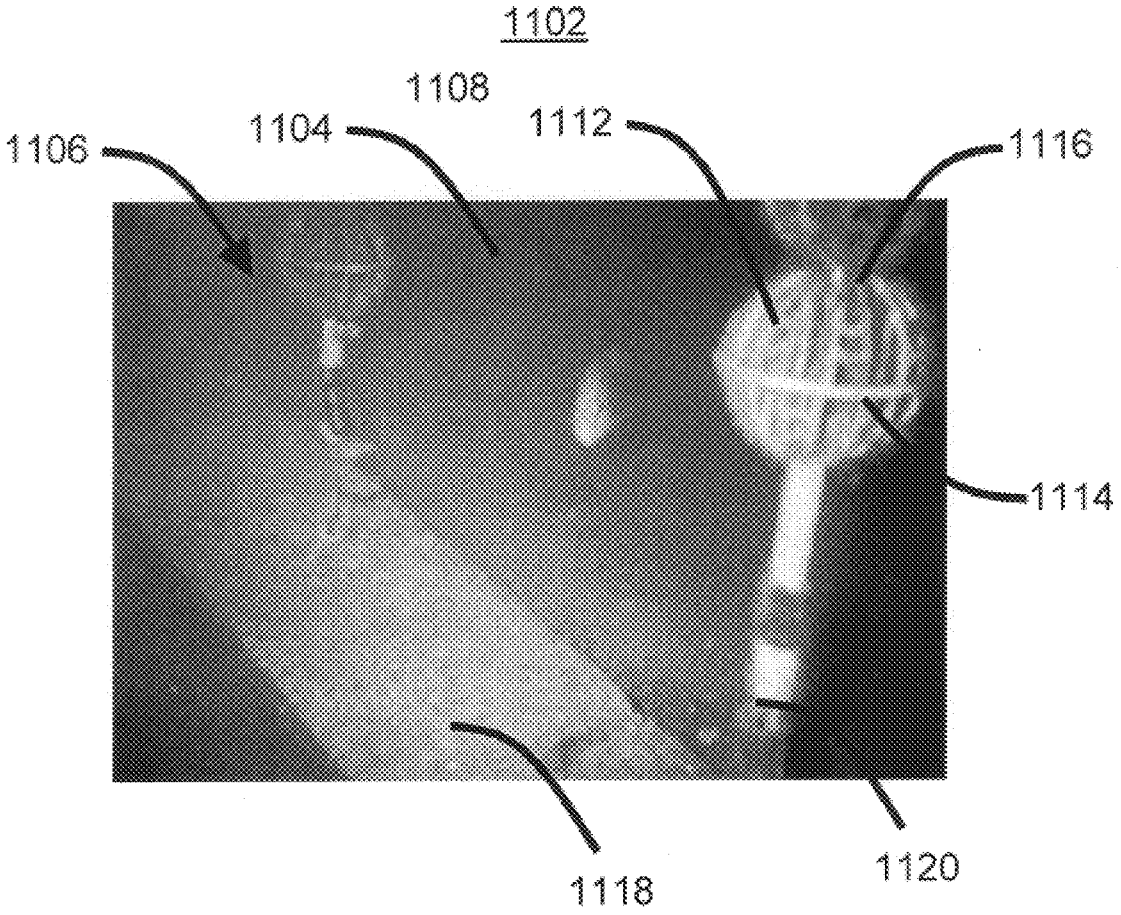
FIG. 11 is a photograph of algae growth on the artificial reef of the present invention deployed within a body of water and a fish attracted to the artificial reef.

FIG. 11 is a photograph illustrating an artificial reef 1102 of the present resting on a floor 1104 of body of water 1106. Algae 1112 grow inside and outside latticework open bodies 1114 of a string 1116 of open bodies 1114. String 1116 is attached to a concrete anchoring block 1118 by a linking means 1120.

Although the artificial reef of the present invention may be any length, in a preferred embodiment of the present invention, when the artificial reef is deployed in an open body of water such as an ocean, gulf or bay, the length the artificial reef deploy is chosen such that at least about sixty feet of open water exists from the top of the artificial reef to the surface of the body of water. The sixty feet allow surface vessels to pass safely above the artificial reef without entangling the artificial reef in the surface vessels propellers. The length of the artificial reef is preferably at least 10 feet and no great than 30 feet so that pelagic fish and deep sea fish, are attracted to the artificial reef in the body of water having depths less than about one hundred and forty feet.

Figure 12:
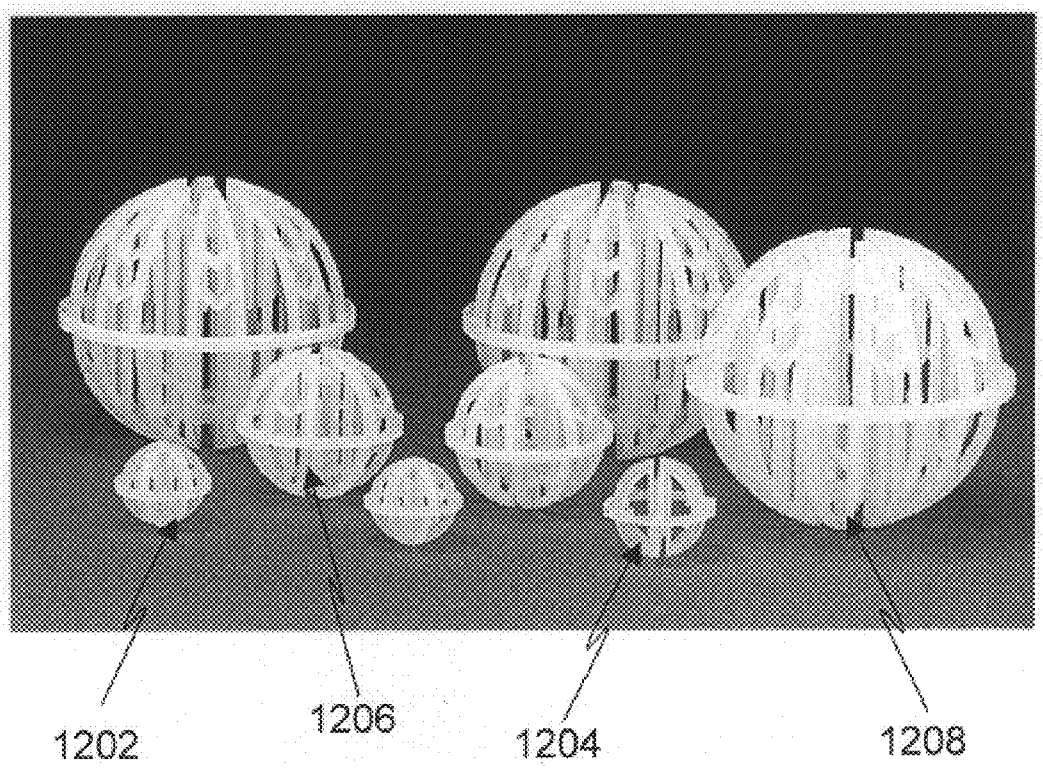
FIG. 12 is a photograph of open bodies that may be used in an artificial reef of the present invention.

A preferred latticework structure for use as the open bodies of the present invention are Jaeger Tri-Packs®. FIG. 12 shows a photograph of Jaeger Tri-Packs® that may be used in the artificial reef of the present invention. Although 1" Tri-Packs® 1202, 1.25" Tri-Pack® 1204, and 2" Tri-Packs® 1206 may be used in artificial reefs of the present invention, a particularly preferred Tri-Pack® is a 3.5" Tri-Pack 1208. Other preferred open bodies of the present invention are described in U.S. Pat. No. 4,203,935 to Hackenjos, the entire contents and disclosure of which are hereby incorporated by reference.

Although only spherical open bodies have been shown above, the open bodies of the present invention may have other types of shapes such as cubical, pyramidal, rectilinear, irregular shaped, etc. and latticeworks having such shapes may be used in the open bodies of the present invention. Although the open bodies of the present invention are preferably latticeworks, the open bodies of the present invention may be other types of structures, such as pieces of pipe, that allow for algae to grow on the artificial reef of the present invention.

Preferred materials for making the open bodies of the present invention include plastics such as polyethylene, polypropylene, polyvinyl chloride, copolymer polyvinyl chloride (CPVC), fluoro-polymers (such as Kynar®, which is registered trademark of DuPont), fluoro-copolymers (such as Teflon®, which is a registered trademark of DuPont), fluoropolymers (such as Halar® which is a trademark of Ausimont). When the artificial reef of the present invention is deployed in open bodies of water such as oceans, lakes, rivers, etc. preferably the material used to form the open bodies is free of chlorine. Although plastic is preferred material for the open bodies of the present invention, other materials such as metal wire, ceramics, etc. may be used to form the open bodies of the present invention. When the artificial reef of the present invention is used in an open body of water such as the ocean, a gulf or a bay, the open bodies of the artificial reef preferably have openings having diameters of about one twentieth of an inch to about four inches.

The open bodies of the present invention are preferably slid onto the linking device of the present invention and are restrained from moving distally or proximally by restraining devices such as washers.

Each open body with its internal structure has openings that allows smaller fish to eat the algae, which can grow inside the open body, but larger fish cannot eat the algae. The larger fish are attracted to the artificial reef because of the smaller fish. Thus, the structure of the open body can support different types of marine life in an area where little or no marine life existed before.

In artificial reefs of the present invention that employ linking device comprising a cable that extends through a hollow tube, the cable is preferably slightly smaller in diameter than hose through which the cable extends to allow the cable to be easily slid through the hose and to reduce wear between the hollow tube and cable. One preferred combination of cable and hollow tube is a ¼" stainless steel cable used for the cable and a ⅜" 300 psi air hose with a nitrile cover used for the hollow tube. Another preferred combination of cable and hollow tube is a ⅜" diameter twisted polypropylene rope used as the cable and a ⅝" diameter copolymer PVC pipe used as the hollow tube.

A linking device comprising a hollow tube and interior cable may be formed by fitting a cable through a hollow tube, such as plastic hose, under pressure. A linking device including both a hollow tube and an interior cable has many advantages. For example, such a linking device is relatively flexible, so that the artificial reef can move or sway in currents as strong as 2.5 knots. Such movements of the artificial reef attracts more fish to the artificial reef. The hollow tube of such a linking device allows the open bodies to be easily slid onto the linking device and protects the interior cable in the region of the open bodies. The use of an interior cable increases the strength of the linking device over what may be obtained with the hollow tube alone. When the hollow tube is sealed at each end to the interior cable to form an enclosure in the hollow tube, the enclosure that is filled with air, another gas, a liquid, etc. may provide additional buoyancy to the string of open bodies.

The cable device of the present invention may be a cable, a wire or a chain made from a suitable material such as metal or plastic. A preferred cable is ⅜" in diameter comprised of stainless steel having test strength of at least 12,000 pounds.

Preferably, the thimbles attached to the cable of the present invention are made of a hard and durable material such as stainless steel, plastic, etc. A preferred thimble is non-magnetic stainless steel thimble manufactured by Biloxi Fishnet Co. Preferably the thimble is attached to a cable of the present invention using a ¼" stainless steel slip type clip and nuts and bolts.

Preferably, the restraining washers of the present invention are made of any conventional material used for washers including metals, plastics rubber, etc.

Preferred compression clamps of the present invention are slip type clips that are clamped onto a hollow tube or cable of the present invention by nuts and bolts.

Preferred restraining devices for use in the present invention are stainless steel washers. The stainless steel washers may be fixed to the linking device of the present invention in a variety of ways such as: crimp fitting the washer to a hollow tube of the present invention, using an adhesive to adhere the washer to the hollow tube of the present invention, etc. Although a stainless steel washer is a preferred restraining device other restraining devices used to maintain the position of floats on a cable may be used with the artificial reef of the present invention.

Preferred methods for joining a ball float of the present invention to a torpedo float include using an adhesive, nylon netting, etc.

In a preferred embodiment of the present invention, the floatation device includes hollow ball float fused to a torpedo float and a utility float, such as is shown in FIG. 4. The hollow ball float may have a spherical, cylinder, square, triangular, etc, shape. The hollow ball float may be filled with air, gas, liquid, etc. that will cause the ball float to be located using sonar. A preferred embodiment of the present invention is for the utility float to be hollow so that it simulates a fish's bladder which may be detected by an electronic fish finder to locate the artificial reef in the body of water once deployed. The torpedo float is typically made from plastic and is filled with a porous solid material such as styrofoam, PVC foam, etc. The utility float is preferably a float that is relatively durable and less prone to damage the torpedo float and hollow ball floats. A preferred utility float is PVC foam manufactured by Carlon.

The floatation device may include an eye hook or other hooking device such as a U-bolt located at the proximal end of the floatation device, so that divers may attach a cable to lift the entire artificial reef from the body of water's floor and raise the artificial reef to the surface.

Preferred anchoring devices for use in the artificial reefs of the present invention are made of a dense, durable material such as concrete. One preferred anchoring device is a concrete block, similar to a parking lot bumper. Other materials suitable for use in making the anchoring device of the present invention include: metal barrel filled with concrete, or metal, etc. An anchoring device of the present may be attached to one string of open bodies or several strings of open bodies. In general, the greater the number of strings attached to the anchoring device, the heavier the anchoring device.

The anchoring devices used in the artificial reefs of the present invention preferably include one or more hooks or U-shaped structures, such as on ore more stainless steel U-bolts, to allow one or more strings of open bodies to be connected to the anchoring device. The size of the anchoring device and the number of strings of open bodies that may be attached to the anchoring device will be dependent on the particular application of the artificial reef of the present invention. For example, if the artificial reef is to be deployed by only two individuals, preferably the anchoring device would have weight of no greater than around 100 to 140 pounds to allow two adult males to easily lift the anchor from a surface vessel and toss it over the side of surface vessel into the body of water. In contrast, if a mechanical crane is used for deploying the artificial reef of the present invention, a larger and heavier anchoring device having many more structures for attaching strings of open bodies to the anchoring device may be used. Also, although in the embodiments described above, the strings of open bodies are attached on the anchoring device in a line of strings, the anchoring device could include connecting structures that allow open bodies to be attached to the anchoring device in other arrangements, such as in a triangle, square, etc. When multiple strings are used in the artificial reef of the present invention, each artificial reef may be attached to an individual anchoring device and the individual anchoring devices may then be connected to each other.

In one preferred embodiment, the linking device of the present invention may be used to connect the anchoring device of an artificial reef to the floatation device of the artificial reef. The linking device may be connected to the anchoring device or floatation device by either using a fastener combination, a locking combination, a knot in the cable to an attachment to anchoring device or floatation means, fusing the cable in the anchoring device or floatation means, etc., or any combination thereof.

Although the present invention has been fully described in conjunction with the preferred embodiment thereof with reference to the accompanying drawings, it is to be understood that various changes and modifications may be apparent to those skilled in the art. Such changes and modifications are to be understood as included within the scope of the present invention as defined by the appended claims, unless they depart therefrom.

What is claimed is:

1. An artificial reef comprising:

a plurality of open bodies;

linking means for arranging said open bodies in at least one string of open bodies;

an anchoring means connected to said at least one string of open bodies at a distal end of said string of open bodies, said anchoring means anchoring said artificial reef when said artificial reef is deployed in a body of water;

a floatation means attached to a proximal end of said at least one string of open bodies, said floatation means causing said at least one string of open bodies to extend upward when said artificial reef is deployed in a body of water, wherein at least one of said open bodies comprises a latticework structure and said latticework comprises: an annular meridian ring and a plurality of arcuate bars extending upwardly and downwardly from said annular meridian ring.

2. The artificial reef of claim 1, wherein each of said open bodies is substantially spherical.

3. The artificial reef of claim 2, wherein said open body has a diameter of about three to about four inches.

4. The artificial reef of claim 1, wherein said open body has a diameter of about three to about four inches.

5. The artificial reef of claim 1, wherein said latticework includes openings having a diameter of about one twentieth of an inch to about four inches.

6. The artificial reef of claim 1, wherein said open bodies comprise an injection moldable resin.

7. The artificial reef of claim 1, wherein said open body has a diameter in at least one direction of about three to about four inches.

8. The artificial reef of claim 1, wherein each of said open bodies has substantially the same shape.

9. The artificial reef of claim 1, wherein said linking means comprises one continuous linking means extending through said plurality of open bodies.

10. The artificial reef of claim 9, wherein said open bodies are slidable on said linking means.

11. The artificial reef of claim 10, further comprising restraining means for restraining the sliding of said open bodies on said linking means.

12. The artificial reef of claim 1, wherein said linking means comprises a hollow tube and an inner cable extending through said hollow tube.

13. The artificial reef of claim 12, wherein said hollow tube is sealed to form a hollow enclosure through which said inner cable extends.

14. The artificial reef of claim 13, wherein said floatation means includes said hollow enclosure.

15. The artificial reef of claim 12, wherein said inner cable is connected to said anchoring means and said floatation means.

16. The artificial reef of claim 1, wherein said linking means comprises a plurality of segments connecting adjacent open body of said plurality of open bodies to each other.

17. The artificial reef of claim 1, wherein said string of open bodies comprises a linear string.

18. The artificial reef of claim 1, wherein said string of open bodies comprises a branched string having a plurality of branches and wherein said floatation means comprises at least one float attached to a branch proximal end of at least one of said branches.

19. The artificial reef of claim 18, wherein said floatation means comprises at least two floats, each of said floats being attached to a branch end of two respective branches of said plurality of branches.

20. The artificial reef of claim 19, wherein said floatation comprises at least one float including hollow space in at least one float.

21. The artificial reef of claim 20, further comprising a utility float.

22. The artificial reef of claim 1, wherein said anchoring means comprises a concrete block attached to said proximal end of said linking means.

23. The artificial reef of claim 1, wherein said floatation means comprises a single float.

24. The artificial reef of claim 1, wherein said floatation means comprises at least one float having an connecting means for connecting a cable to said float for retrieving said artificial reef from a body of water.

25. The artificial reef of claim 1, wherein said at least one string of open bodies comprises a plurality of strings of open bodies.

26. The artificial reef of claim 25, wherein said plurality of strings of open bodies are attached to a single anchoring means.

27. A method of deploying an artificial reef comprising:

providing an artificial reef comprising:

a plurality of open bodies;

linking means for arranging said open bodies in at least one string of open bodies;

an anchoring means connected to said at least one string of open bodies at a distal end of said string of open bodies; and a floatation means attached to a proximal end of said at least one string of open bodies, said floatation means causing said at least one string of open bodies to extend upward when said artificial reef is deployed in a body of water; and deploying said artificial reef in a body of water wherein at least one of said open bodies comprises a latticework structure and said latticework comprises: an annular meridian ring and a plurality of arcuate bars extending upwardly and downwardly from said annular meridian ring.

28. The method of claim 27 further comprising anchoring said artificial reef to the floor of said body of water.

* * * * *